US008770889B2

(12) United States Patent
Sharp

(10) Patent No.: US 8,770,889 B2
(45) Date of Patent: Jul. 8, 2014

(54) METHOD OF WATERPROOFING A CONTAINMENT SUMP

(76) Inventor: Scott R. Sharp, Cincinnati, OH (US)

( * ) Notice: Subject to any disclaimer, the term of this patent is extended or adjusted under 35 U.S.C. 154(b) by 186 days.

(21) Appl. No.: 13/531,897

(22) Filed: Jun. 25, 2012

(65) Prior Publication Data

US 2013/0343819 A1 Dec. 26, 2013

(51) Int. Cl.
*E02D 29/14* (2006.01)

(52) U.S. Cl.
USPC ..... 405/52; 405/54; 230/560.03

(58) Field of Classification Search
USPC ..... 405/52–55; 220/560.03; 137/236.1
See application file for complete search history.

(56) References Cited

U.S. PATENT DOCUMENTS 4,078,430 A 3/1978 Pemberton et al.
4,798,496 A 1/1989 Sawada
5,085,257 A 2/1992 Smith
5,589,631 A 12/1996 Spring et al.
5,992,220 A 11/1999 Pardoe
6,171,029 B1 1/2001 McGill et al.
6,189,717 B1 2/2001 Versaw, Jr. et al.
7,150,582 B2 12/2006 Burwell
7,171,994 B1 2/2007 O'Brien
7,229,233 B2 6/2007 Burwell et al.
7,712,259 B1 5/2010 Pettesch

*Primary Examiner* — Benjamin Fiorello
*Assistant Examiner* — Kyle Armstrong
(74) *Attorney, Agent, or Firm* — Charles R. Wilson

(57) ABSTRACT

A method is provided for preventing water from entering a containment sump of an underground storage tank. After accessing an interior of the sump and interrupting the flow paths of piping, a form is positioned in the sump. An annular open space formed between the sump's sidewall and the form is substantially filled with a settable material. An inside wall of the form next has applied to it a polymeric material to seal off an source of water seepage. The piping flow paths are reestablished to create a waterproof containment sump.

14 Claims, 9 Drawing Sheets

METHOD OF WATERPROOFING A CONTAINMENT SUMP

FIELD OF THE INVENTION

This invention relates to a method of waterproofing a containment sump. More particularly, the invention relates to a method of waterproofing a containment sump of an underground storage tank.

BACKGROUND OF THE INVENTION

Underground storage tanks are widespread, primarily at gasoline service stations. The service station tanks are large capacity tanks typically holding 10,000 to 20,000 gallons of gasoline. They are buried sufficiently deep that their top surface is about one to four feet below ground surface. The storage tank and its accessories still are regularly exposed to water, as from rain water ground seepage or a high water table.

A containment sump is mounted on top of the underground storage tank either directly or indirectly. The sump houses piping, pumps, and other accessories needed for proper tank use. The typical containment sump is about one to three feet in diameter and about one to three feet in height. It further has a lid. The lid is accessed by a manhole located in the ground above the sump. A manhole cover at the surface is removable to gain access to the sump's lid and ultimately the sump's interior if needed.

A problem experienced by many existing containment sumps is that water flows into the sump's interior—even to the extent of filling it on occasion. The water can enter the sump by flowing around an edge of the manhole cover and down onto the sump's lid. Gaskets and other seals designed to prevent this are successful to a limited degree. Even with a properly sealed manhole cover and sump lid, water still seeps in. The water further can enter into the sump through openings provided in the sump's wall to accommodate piping as well as through wall gaps, cracks, or holes which can form over time.

Water seepage into containment sumps is a recognized problem in the industry. Service station operators are aware of the problem and most have tried to address it. The problem is compounded by the fact water build-up in the containment sump likely is not immediately recognized. The manhole cover and the sump's lid must first be removed. This requires time and usually simply is not done even though environmental laws may require it. It is, of course, checked when any water seepage problem manifests itself, e.g. by an electric malfunction or contaminated gasoline. By then, the damage is done.

The fact remains there is an obvious need for preventing water from entering containment sumps of underground storage tanks. The need is felt with existing storage tank sumps and with new tank installations. There has now been developed an effective method of preventing water from entering the containment sumps. The method is useful in a retrofit setting as well as in a new installation setting. The method further includes a means for periodically checking for water seepage in a safe convenient manner.

SUMMARY OF THE INVENTION

A method of preventing water from entering a containment sump of an underground storage tank comprises the initial steps of accessing an interior of the sump and interrupting the flow path of piping extending into the sump's interior. Next, a form is positioned in the sump's interior and a settable mixture poured in an annular space formed between the form and the containment sump's sidewall. The flow paths of the piping are reestablished. Finally, entries where the piping enter the interior area are sealed and a polymeric mixture applied over substantially the full interior surface of the form. An optional step includes installing a lid with a viewing port light admitting window over the sump's open top. For certain areas particularly prone to water problems, a preliminary method step is undertaken wherein a flowable sealant is injected into the soil around the containment sump.

DETAILED DESCRIPTION OF THE INVENTION

The method of the invention is described below in detail and with reference to the drawings. The method depicted is in a retrofit situation with an existing containment sump positioned on an underground storage tank. The method can also be practiced when installing a new underground storage tank.

All manner of containment sumps are amendable to the method of the invention. A common style containment sump is one piece and mounts directly onto the storage tank's manway. The containment sump can as well be two piece with a sidewall and a bottom wall joined by mechanical or adhesive joining means. In some instances, containment sumps have no bottom wall, in which case it is necessary to fabricate one and attach it to the sidewall. It should be understood other containment sump styles can be used in the invention, including those that mount directly to a tank top's surface and those that are mounted to a fill pipe extending directly from the tank's top surface. Still further, certain styles of containment sumps are installed directly below a gasoline dispenser used by the customer. These sumps tend to be generally rectangular-shaped and sized to approximately match the gasoline dispenser above it.

Figure 1:
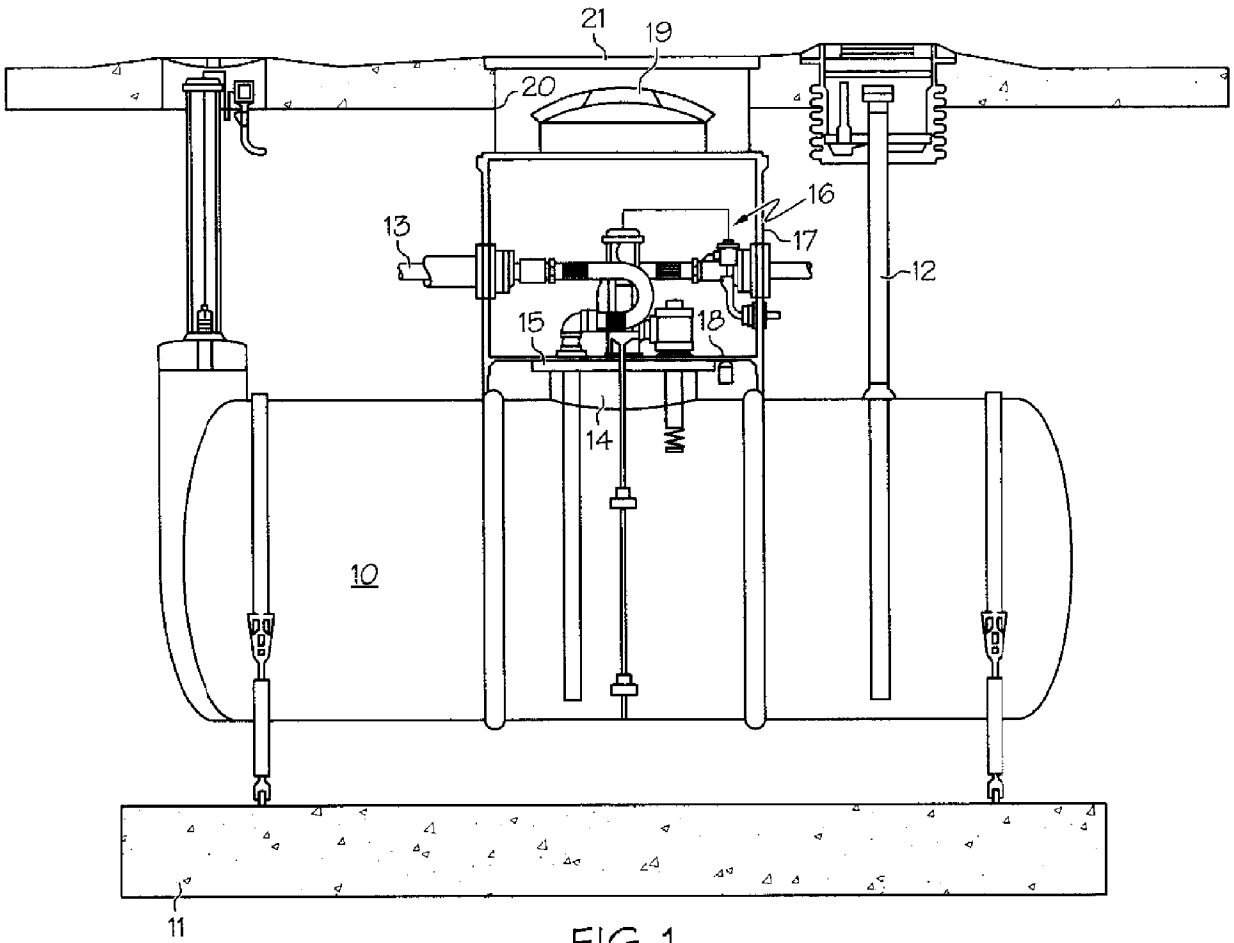
FIG. 1 (PRIOR ART)
FIG. 1 is a side view in elevation showing a typical prior art underground storage tank with a containment sump mounted on the tank's manway.
Figure 2:
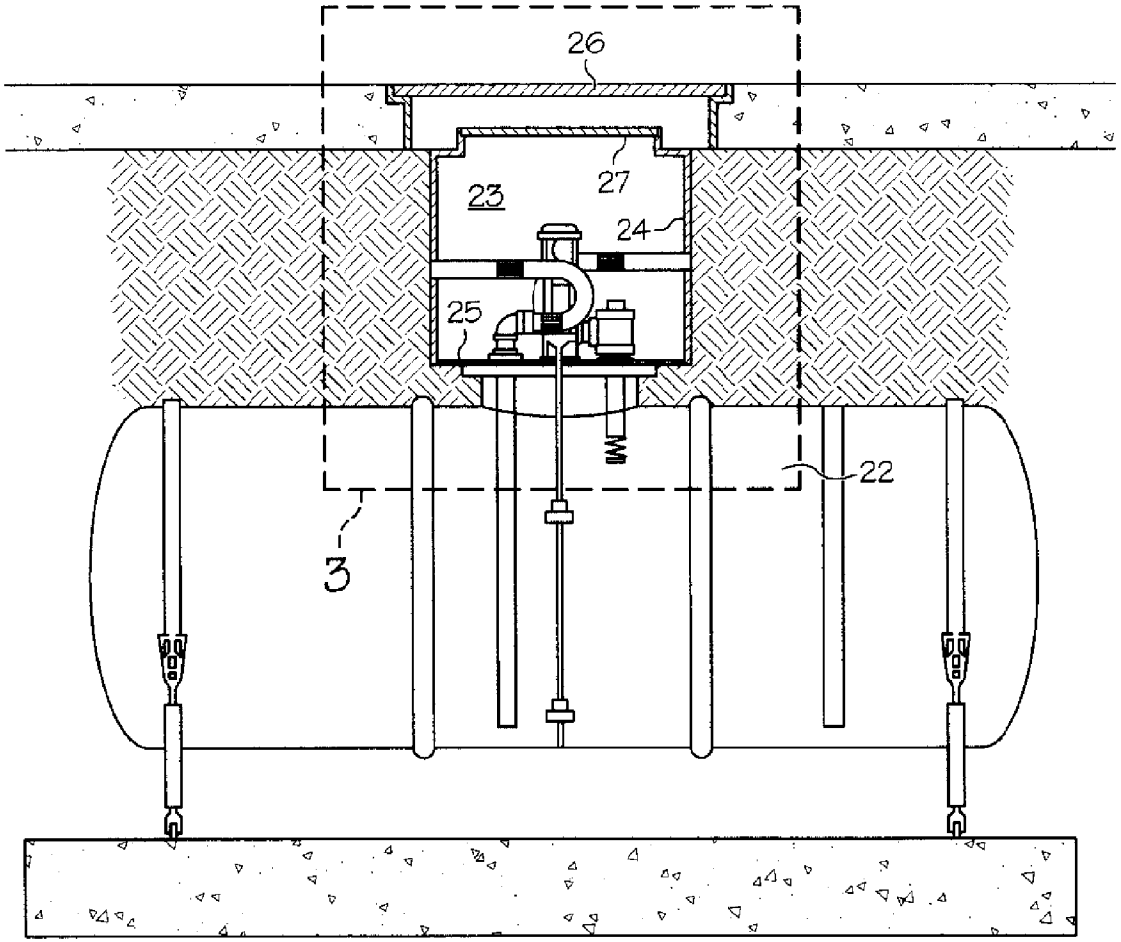
FIG. 2 is a side view in elevation of the underground storage tank of FIG. 1 with a similar style of containment sump and with a portion of piping and associated equipment removed for purposes of clarity.

FIG. 1 shows a typical prior art underground storage tank 10 anchored to a concrete pad 11 to prevent tank floating. A fill 20 line 12 is used to receive gasoline from a tanker truck for periodically refilling the tank. A supply line 13 leads to a pump (not shown) used by the consumer. The tank 10 has a manway 14 extending from its top surface. It includes a manway cover 15. A containment sump 16 is mounted onto the manway. It includes a cylindrical-shaped sidewall 17, a bottom wall 18 and a sump lid 19 which is just below ground surface. A manhole skirt 20 and manhole cover 21 are provided to access the sump lid and ultimately the interior of the containment sump.

Containment sumps as depicted in FIG. 1 art are not waterproof. Surface water such as from rain tends to flow around a periphery of the manhole cover, even to the extent of filling the space above the containment sump. This then allows water to enter the sump since its lid is often not sealed shut. The surface water as well as ground water found in high water table areas also can leak into the containment sump where piping extends through a sidewall or wherever a wall seam or accessory attachment is located. Either source of water seepage is undesired. For purposes herein, water seepage is intended to include seepage caused by surface water or ground water.

FIGS. 2-5 illustrate the method of the invention. Now with particular reference to FIG. 2, there is shown a section of an underground storage tank 22 and a containment sump 23 in particular. The containment sump style, as shown, is of most interest in this invention due to its extensive use. It is a one piece construction with a cylindrical-shaped sidewall 24 and a bottom wall 25 molded so as to not have a seam. The interior of the containment sump is accessed by removing the manhole cover 26 and the sump's lid 27.

Figure 3:
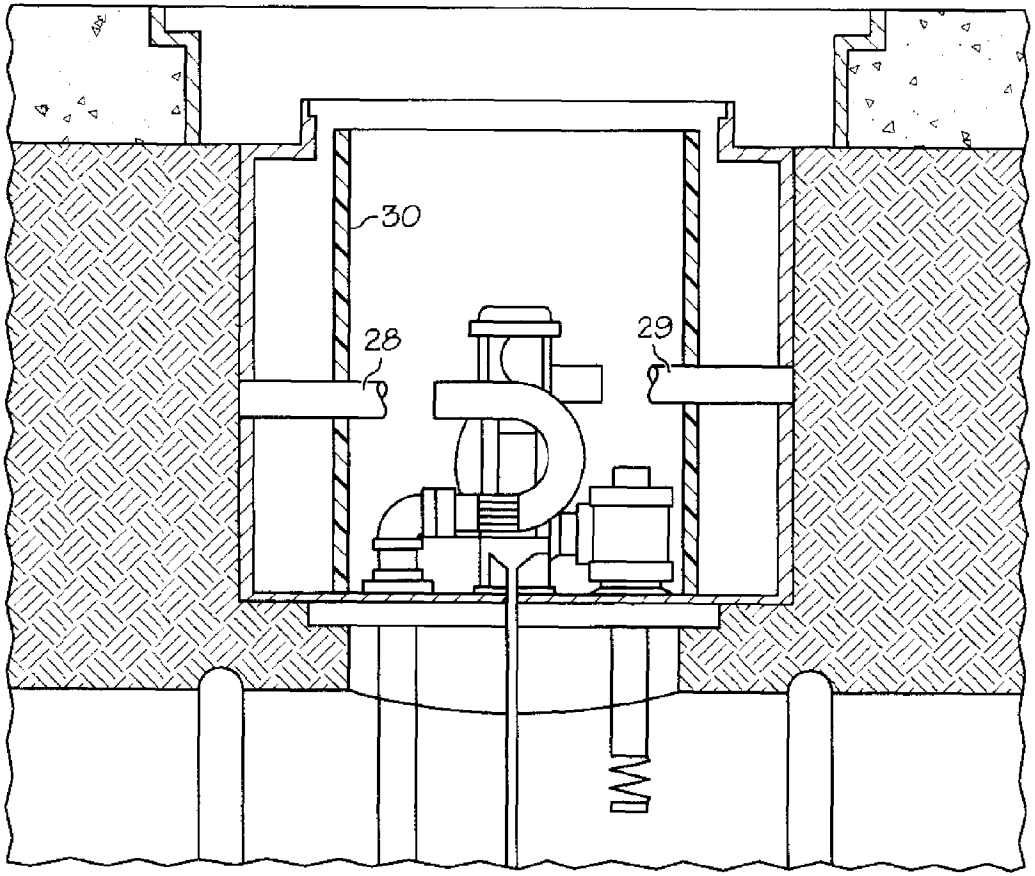
FIG. 3 is a side view in elevation of the storage tank and containment sump section defined by dotted lines in FIG. 2 wherein a manhole cover and a sump lid have been removed, piping within the sump has been interrupted, and a form has been added.

As seen in FIG. 3, and in accord with the method of this invention, the manhole cover has been removed to access the containment sump. The sump's lid has also been removed to access the interior of the sump. If need be, a portion of the sump's top wall can also be removed, such as by cutting, to get sufficient access to the sump's interior to carry out all the steps of the method.

Again with reference to FIG. 3, the piping 28 and 29 extending through the sump's sidewall and leading to the containment sump's interior must then be interrupted. The piping can be simply cut or, if a fitting of some nature is available, the fitting removed. The purpose of interrupting the piping's flowpath is to allow insertion of a form into the sump's interior which extends down to the bottom wall of the sump. As such, the length of piping needed to extend just inside the form's wall is measured and cut or a fitting removed. Sufficient piping stubs must remain which can be used to ultimately reconnect all piping.

Still with reference to FIG. 3, a form 30 is now positioned inside the containment sump. The form has sufficient rigidity to support itself. It is made of any material which will seal with subsequently applied material. Fibre-reinforced plastic, plastic, and metal are examples of suitable form materials. The form of most interest is generally cylindrical-shaped. It has a diameter to sit in the sump such that an annular open space of at least about one inch is created between the sump's inner sidewall and the form's outer sidewall. The height of the form is sufficient for the form to extend from the sump's base up to or near the sump's top surface. The exact height is dependent on the height of the containment sump, though typically is about one foot to about three feet. Proper placement of the form in the containment sump creates two open spaces. The annular open space and the form's interior open space.

It should be apparent that prior to positioning the form inside the containment sump piping holes in the form need to be cut so that all piping stubs can be inserted through them. This necessarily means that the holes will be greater in diameter than the piping to allow for installation. Once the form is positioned, it is next necessary to seal the piping to the form's walls to eliminate any possibility of leakage into the interior open space. This is accomplished best by applying a putty or similar material to plug any gaps.

Figure 4:
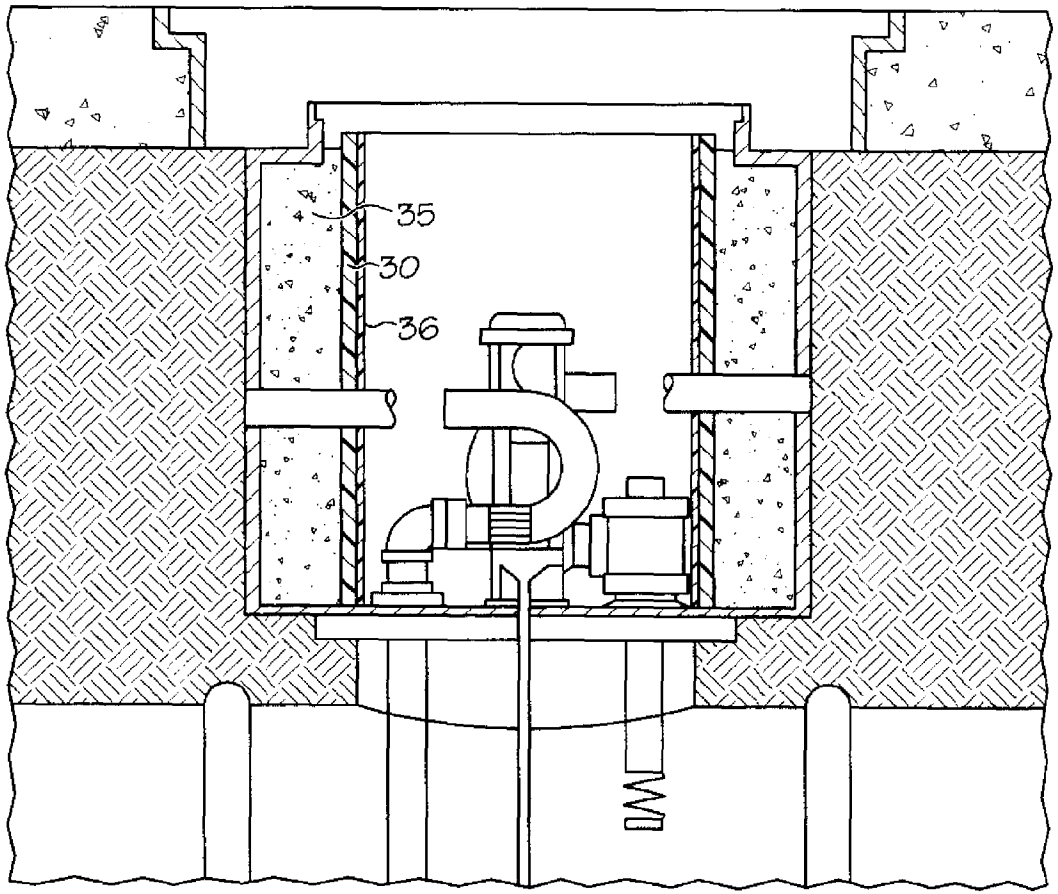
FIG. 4 is a side view in elevation of the containment sump section of FIG. 3 illustrating the inclusion of a Gettable material in an annular open space between the sump's sidewall and the form's outer wall and the application of a polymeric material to the form's inner wall.

FIG. 4 illustrates the next steps of the method of the invention. First, a settable mixture 35 is introduced into the annular open space to substantially fill it. The settable mixture can be in slurry, suspension, solution, or any other flowable form. Cement is one example of a settable mixture and readily available. A liquid polymeric material which cures to a solid is another example. An expandable polymeric foam material is still another example. More preferably, an expandable polymeric open cell polyurethane foam is used. The open cell nature of the foam makes it gas pervious to facilitate detection of any leakage.

Second, openings where piping enters the reduced inner open space are sealed. Third, a polymeric material 36 is applied to the interior wall of the form to further enhance the waterproofing effect of the settable mixture as well as to seal any source of water leakage (no matter how remote) such as the piping entry areas and at the form's base where it sits on the sump's bottom wall or perhaps even the manway's cover. Suitable polymeric materials must be capable of adhering to the form and be capable of not cracking or otherwise deteriorating due to temperature extremes. Preferably, the polymeric material is quick setting or at least essentially non-flowable once it is applied. A thin layer of the order of at least about 20 mils is adequate.

Figure 5:
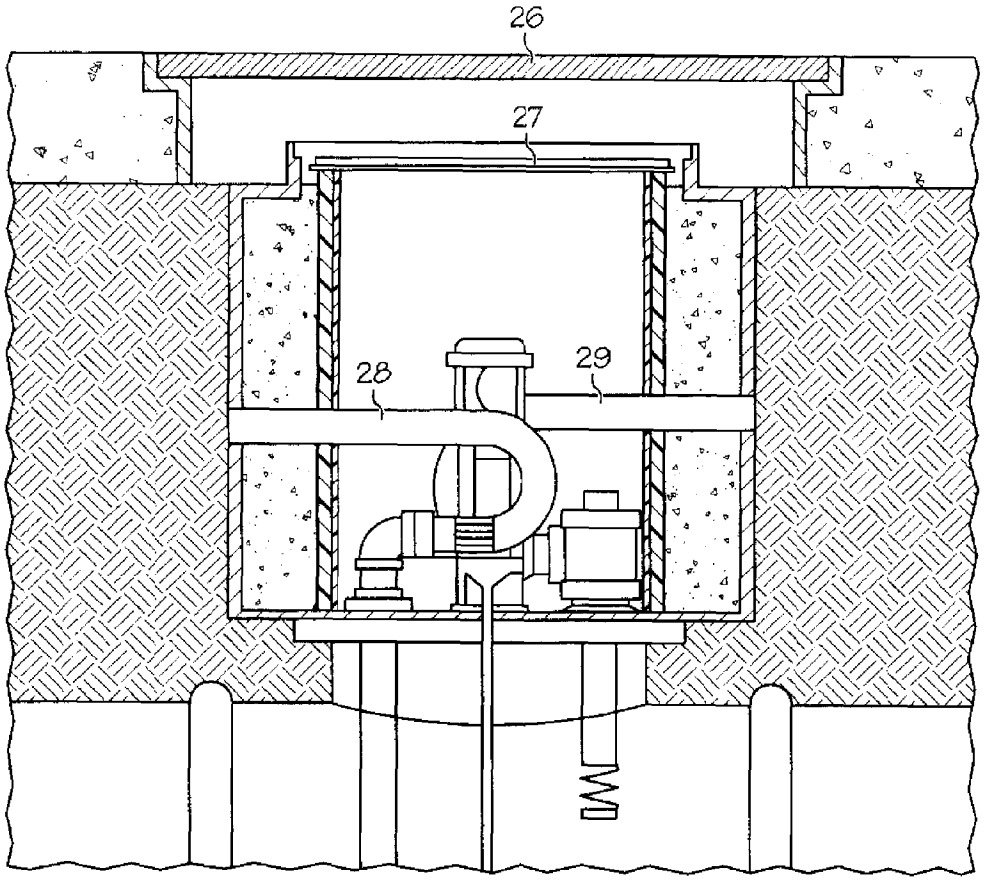
FIG. 5 is a side view in elevation of the containment sump section of FIG. 4 wherein the sump's lid and manhole cover have been reinstalled.

FIG. 5 illustrates the last steps in the waterproofing method. The flow paths of all piping are reestablished. For those pipes which are double walled, a leak detection tube is positioned in an annular space around a fuel inner pipe, the annular space's opening sealed off, and then the inner pipe reconnected. Finally, the containment sump's lid 27 is reinstalled and the manhole cover 26 is reinstalled.

Figure 6:
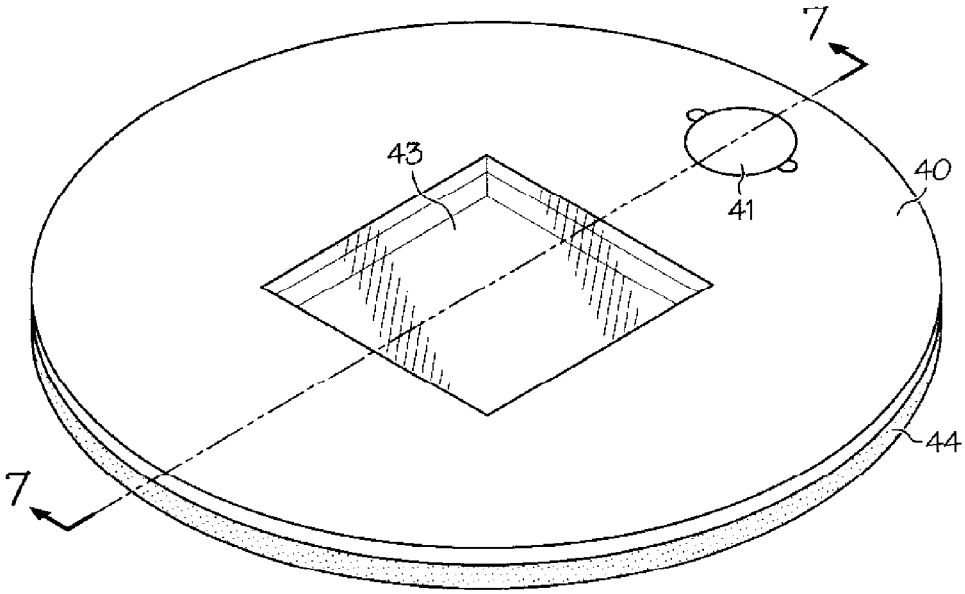
FIG. 6 is a perspective view of a preferred lid which can be used on the containment sump of FIG. 5.
Figure 7:
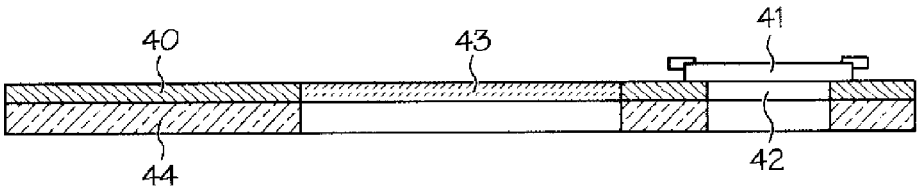
FIG. 7 is a side view in section of the containment sump's lid of FIG. 6.
Figure 8:
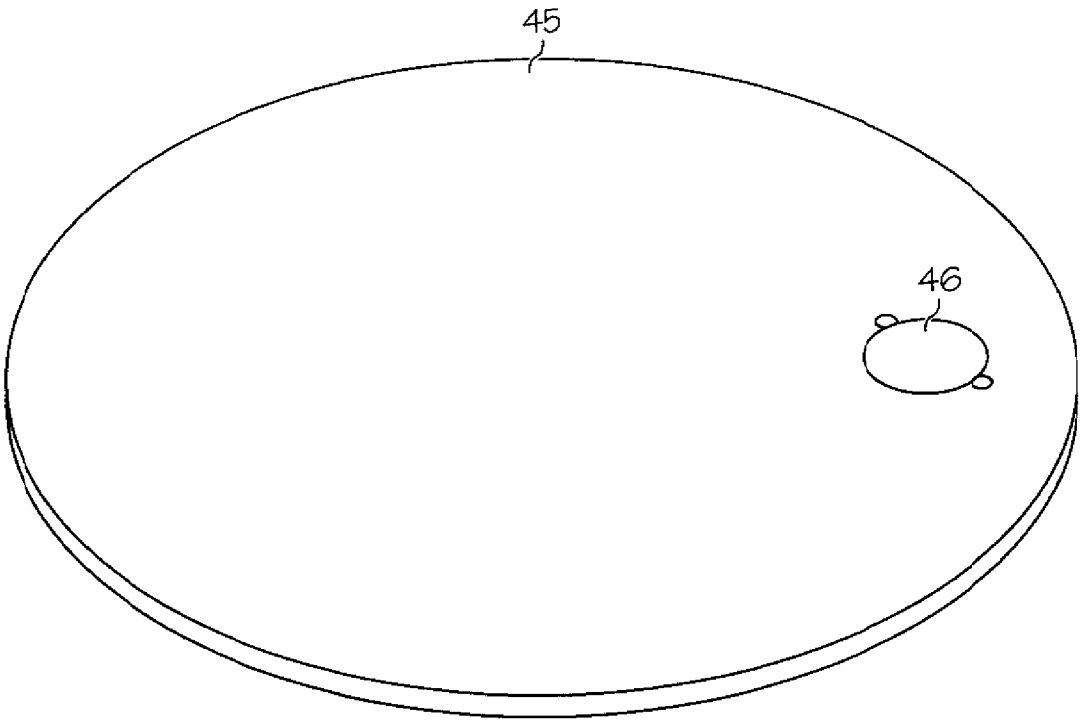
FIG. 8 is a perspective view of another light admitting sump lid with a viewing port.

Preferably, sump lids of the nature illustrated in FIGS. 6-8 are used. With reference to FIGS. 6 and 7, a sump lid 40 includes a removable cap 41, an underlying viewing port 42 and a light admitting window 43. The viewing port and the light admitting window are to allow the service station operator to view the bottom of the sump to detect any water without having to go through the rather cumbersome task of removing the full sump lid. The window 43 allows natural light to illuminate the sump's interior while the viewing port allows an unobstructed view. That is, there is no window glare or condensation formation which obstructs any viewing. The light admitting window can be glass, but more preferably is a clear or translucent plastic to lessen any chance of breakage. It can be any shape, e.g. circular or square as shown. It ideally has an area of at least about 100 square inches. Further, the light admitting window is centrally located. A layer of insulation 44 can be adhered to the lid 40 to reduce the formation of condensation within the containment sump, though is not always needed.

FIG. 8 illustrates a second sump lid 45 which also is light admitting. The lid itself is made of a clear or translucent material which admits sufficient natural light to illuminate the containment sump's interior. Acrylic is one example of such a material. The removable cap 46 and underlying viewing port serve the same purpose as that described with reference to FIGS. 7 and 8.

Figure 9:
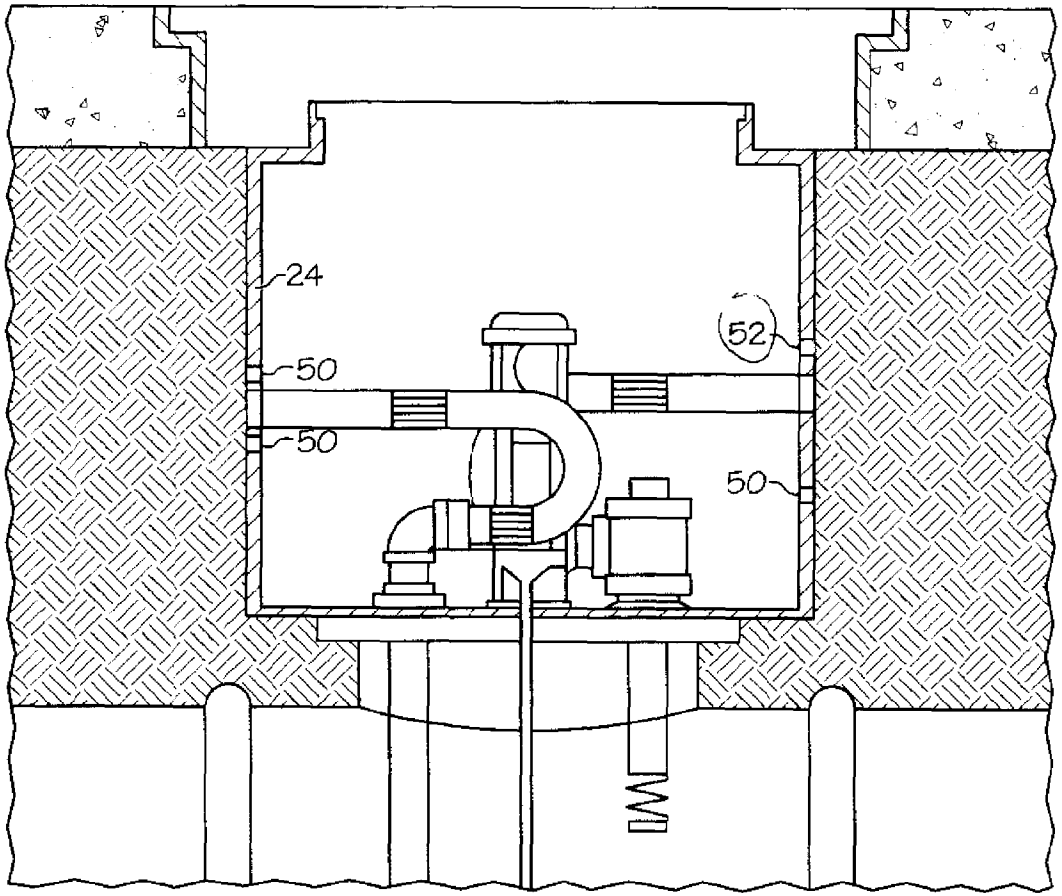
FIG. 9 is a side view in elevation of a preliminary step used in a preferred embodiment of the method illustrated in FIGS. 2-5 wherein a set of spaced access holes has been drilled through the containment sump's sidewall.
Figure 10:
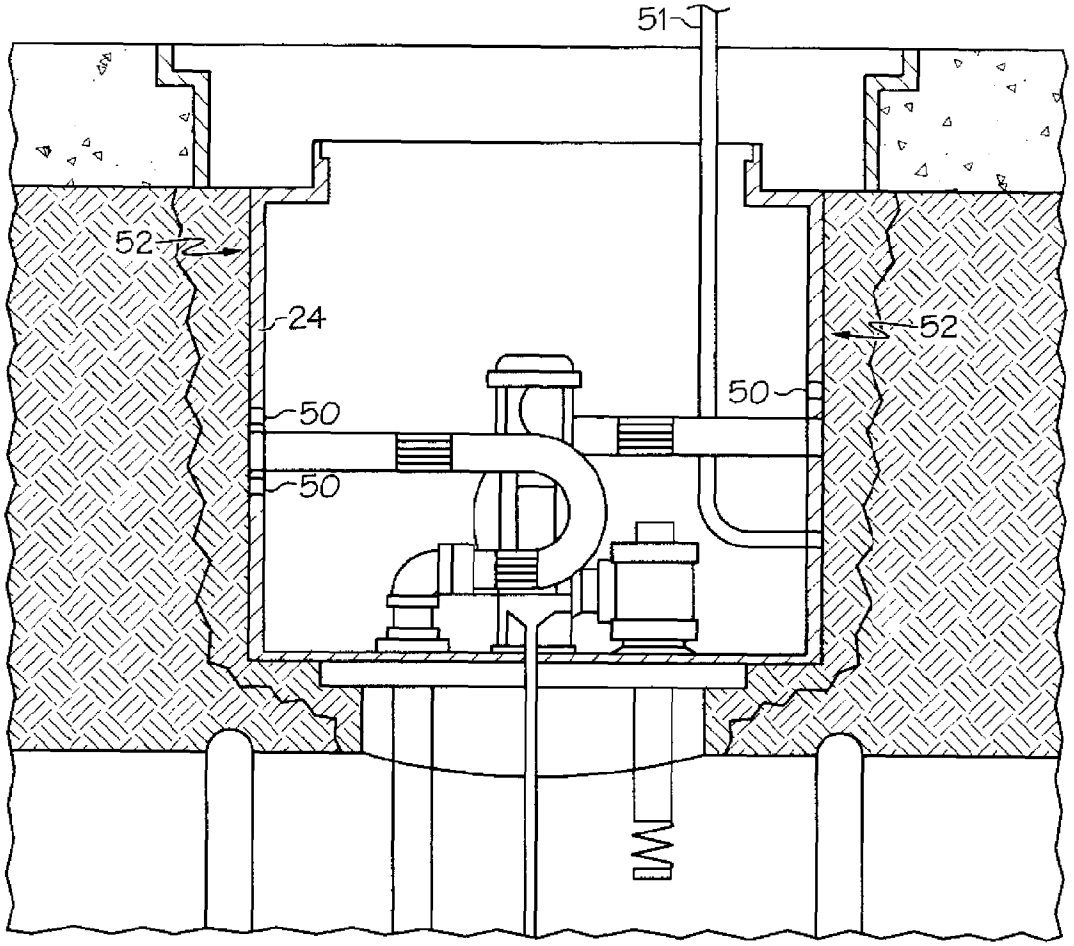
FIG. 10 is a side view in elevation of the containment sump of FIG. 9 wherein a ground penetrating flowable sealant is delivered through one of the spaced access holes to flow around the sump so as to extend substantially fully over the sump's outer wall.

As seen in FIGS. 9 and 10, an optional method step can be initially performed for those areas where water seepage has been overly troublesome. The step entails encompassing the outside of the containment sump with a sealant which eliminates or, at least, retards water from even reaching the sump's outside wall. The first step in the optional method step is to drill a set of spaced soil access holes 50 through the sump's sidewall. The number of soil access holes and the spacing of the holes is based on the fill soil which surrounds the sumps. The exact number and spacing is routinely determined. Normally, at least about four holes are substantially equi-spaced mid-way around the sidewalls. This allows the sealant to be delivered substantially equally upwardly and downwardly along the wall and into the surrounding soil. Additionally, at least one access hole is formed around each piping access hole and at or near any seams which the sump may have. As evident, access holes have been formed where the piping passes through the sump's sidewall. Such areas have proven to be a major source of water leakage.

Now with reference to FIG. 10, a sealant supply line 51 is inserted into one of the spaced access holes and a ground penetrating flowable sealant delivered into the immediate outer area around the sump's wall. The sealant is flowable and, when under pressure, is ground penetrating. It will take the path of least resistance to continue to flow until the operator determines the sump's wall serviced by the access hole is fully covered with the sealant. At least about one inch thickness of sealant on the sump's outer wall is normally needed to be ensured that water will not be able to reach the containment sump's wall. In some instances, it is necessary to pump sufficient flowable sealant through the access holes to achieve up to about two feet of flowable sealant covering the outer surface of the sump. Most commonly, sufficient flowable sealant is pumped through the access holes so that about three inches to about five inches of sealant substantially covers the entire outer wall of the sump.

The ground penetrating flowable sealant is a polymeric material capable of flowing through the sump's surrounding fill. Epoxies and polyurethanes in liquid form are available for this purpose. They are capable of setting via cross-linking or carrier liquid evaporation and are capable of adhering to the sump's wall. The sealant sets to a gel form which allows it enough flexibility or give to withstand stress cracks. The sealant when properly applied substantially fully covers the sump's outer walls, including sidewall and any bottom wall. That is, the sealant is forced to extend fully up the sump sidewall and around the bottom wall.

Optionally, hole plugs can be inserted into the access holes after the sealant has set. They are not required, though provide some added measure of assurance to the service station owner that any water which is able to penetrate through or around the sealant will not pass through the holes. Various plugs for plugging holes are available and any can be used. As apparent in FIG. 9, all exterior areas of the sump which are possibly exposed to water are either covered by the sealant 52 or by the lid.

For those containment sumps which are installed directly below a gasoline dispenser (which in effect requires no lid assembly, per se) the access holes preferably are formed before the dispenser is installed. The sealant is also injected through the holes at that time to cover the sump's outer wall. For those retrofit situations when the containment sump is already under the dispenser, it is necessary to create access holes in the concrete or asphalt surface covering and deliver the ground penetrating flowable sealant directly to the sump's outer wall.

Having described the invention in its preferred embodiment, it should be clear that modifications can be made without departing from the spirit of the invention. It is not intended that the words used to describe the invention nor the drawings illustrating the same be limiting on the invention. It is intended that the invention only be limited by the scope of the appended claims.

I claim:

1. A method of preventing water from entering an interior area of a containment sump associated with an underground storage tank comprising the steps of:

(a) accessing the interior area of the containment sump;

(b) positioning a rigid form into the sump's interior area, said form extending from a base of the containment sump to at or near a top of the containment sump, whereby the interior area is divided into an outer annular open space and a reduced interior area;

(c) introducing a settable mixture into the outer annular open space to substantially fill it;

(d) sealing any piping to the form where the piping enters through the form; and (e) applying a polymeric material to an interior wall of the form to substantially cover the surface of the form's interior wall, whereby water is blocked from entering the reduced interior area of the containment sump by the settable mixture and by the polymeric material.

2. The method of claim 1 wherein the settable mixture is concrete.

3. The method of claim 1 wherein the settable mixture is an expandable polymeric foam material.

4. The method of claim 1 wherein the settable mixture is an expandable open cell polyurethane foam material.

5. The method of claim 1 wherein the rigid form is cylindrical-shaped.

6. The method of claim 1 wherein the form includes holes for piping to extend through.

7. The method of claim 1 wherein prior to positioning the rigid form into the sump's interior access holes are drilled through the sump's sidewall and a ground penetrating flowable sealant is introduced until said sealant substantially fully covers the sump's outer walls.

8. The method of claim 1 further comprising the step of installing a light admitting lid onto the containment sump.

9. The method of claim 1 further comprising the step of installing a lid with a viewing window onto the containment sump.

10. The method of claim 9 wherein the viewing window of the lid has an area of at least about 100 square inches.

11. The method of claim 1 wherein the polymeric material is applied to the interior wall of the form to result in an at least about 20 mils layer.

12. A method of preventing water from entering an interior area of a containment sump associated with an underground storage tank comprising the steps of:

(a) accessing the interior area of the containment sump;

(b) interrupting the flow path of any piping which extends through the containment sump's sidewalls into the interior area of the containment sump;

(c) positioning a rigid generally cylindrical-shaped form into the sump's interior area, said form extending from a base of the containment sump to at or near a top of the containment sump, whereby the interior area is divided into an outer annular open space and a reduced interior area;

(d) introducing a settable mixture into the outer annular open space to substantially fill it;

(e) reestablishing the flow path of the piping within the containment sump's inner open space;

(f) sealing any piping to the form where the piping enters through the form;

(g) applying a polymeric material to an interior wall of the form to substantially cover the surface of the form's interior wall; and (h) installing a light admitting lid onto the containment sump, whereby water is blocked from entering the reduced interior area of the containment sump by the settable mixture and by the polymeric material.

13. The method of claim 12 wherein the settable mixture is an expandable polymeric foam material.

14. The method of claim 12 wherein the lid is made of a clear or translucent polymeric material.

* * * * *